US005310312A

United States Patent [19]

Balfour

[11] Patent Number: 5,310,312

[45] Date of Patent: May 10, 1994

[54] GAS TURBINE TEST AIRFOIL

[75] Inventor: Ronald B. Balfour, Phoenix, Ariz.

[73] Assignee: AlliedSignal Inc., Morris Township, Morris County, N.J.

[21] Appl. No.: 993,148

[22] Filed: Dec. 18, 1992

[51] Int. Cl.[5] ..... F01D 5/30

[52] U.S. Cl. ..... 416/2; 416/61; 416/241 R

[58] Field of Search ..... 416/2, 61, 204 A, 219 R, 416/220 R, 221, 241 R; 415/9; 73/116, 118.1

[56] References Cited

U.S. PATENT DOCUMENTS

| | | | |
|---|---|---|---|
| 2,925,250 | 2/1960 | Whitehead | 416/215 |
| 3,003,745 | 10/1961 | Ferguson, Jr. et al. | 416/2 |
| 3,050,282 | 8/1962 | Allen et al. | 415/9 |
| 3,291,446 | 12/1966 | Huebner, Jr. | 416/2 |
| 3,758,233 | 9/1973 | Cross et al. | 416/241 R |
| 4,004,860 | 1/1977 | Gee | 416/2 |
| 4,581,300 | 4/1986 | Hoppin, III et al. | 416/241 R |
| 5,018,271 | 5/1991 | Bailey et al. | 416/241 R |
| 5,100,292 | 3/1992 | Matula et al. | 416/220 R |
| 5,160,243 | 11/1992 | Herzner et al. | 416/241 R |

*Primary Examiner*—Edward K. Look
*Assistant Examiner*—Christopher Verdier
*Attorney, Agent, or Firm*—James W. McFarland; Robert A. Walsh

[57] ABSTRACT

A turbine or compressor blade designed for deliberate, controlled failure in a gas turbine engine during testing of the engines, includes a lower-strength tubular insert in an axial through bore in the root portion of the blade, which insert fails at preselected conditions to induce blade failure.

7 Claims, 2 Drawing Sheets

GAS TURBINE TEST AIRFOIL

CROSS-REFERENCE TO RELATED APPLICATION

This application discloses subject matter common to that disclosed in application U.S. patent application Ser. No. 07/993,151 filed simultaneously herewith and having common assignee.

TECHNICAL FIELD

This invention relates generally to gas turbine engines and relates more particularly to an improved airfoil configuration designed for deliberate failure during testing of the gas turbine engine.

BACKGROUND OF THE INVENTION

Gas turbine engines as utilized in the aerospace industry must undergo stringent testing prior to certification. Such testing includes various failure modes of the engine, wherein one or more components of the engine are induced to failure, and the engine reaction to such failure must meet certain standards. For example, one such testing for certification contemplates the loss or failure of a compressor or turbine blade within the engine, and the subsequent ingestion of the broken part through the engine. Dependent upon a particular test the engine must maintain certain minimum performance, and/or comply with controlled failure specifications. Such testing and the results therefrom are most valuable and accurate if they reasonably and reliably occur under conditions of the gas turbine engine as it would be used in service.

A typical prior arrangement for deliberately inducing a failure of a compressor or turbine blade within a gas turbine engine is illustrated in FIG. 1. Here an airfoil 10 has deliberate undercuts 12, 14 machined in a narrow, neck section 16 between the airfoil platform 18 and its root 20. This test blade is inserted in a turbine or compressor wheel of a gas turbine engine which is then run up through speed and power. If failure does not occur, the engine must be disassembled, the undercuts 12, 14 increased in size, and the process repeated gradually until release of the blade occurs to permit the test to proceed. Of course, if the test blade fails prior to reaching the required speed and power of the engine, not only must the test be repeated, but also the entire engine or significant portions thereof must be rebuilt.

These methods for testing a gas turbine engine can be quite time consuming and high in cost. Further, due to the near constant strength of the blade material over the operational temperatures it experiences in the engine, the test blade tends to fail as a function of speed rather than of time. Thus, it may be difficult to determine whether or not the remainder of the engine has reached its normal operating condition (i.e., whether all components of the engines have reached their steady state operating temperature) at the time of the blade release.

SUMMARY OF THE INVENTION

Accordingly, it is an important object of the present invention to provide an improved test airfoil for the gas turbine engine which fails and separates from the wheel in a more controlled and predictable manner.

More particularly, the present invention contemplates an airfoil having an axial through bore in the root portion of the blade. A tubular member of lower strength material is carried in this internal bore. The insert is chosen of a material which exhibits adequate strength margins at lower operating temperatures, but whose strength materially degrades as operating temperature is approached. The insert material fails, primarily preferably through yield deformation, inducing subsequent fracture and failure of the test blade itself. Accordingly, by utilizing the lower strength material which yields once preselected operating conditions are reached, the engine on test may gradually be brought up to operating speed and operating temperature in a reliable manner prior to induced failure.

The present invention further contemplates the inclusion of a slot through the bottom of the root which opens into the internal bore therein to afford an opening through which the insert material may yieldably deform to reliably fail at the preselected conditions, and to allow deflections of the lower portions of the root to predictably increase failure-inducing stress concentrations.

These and other objects and advantages of the present invention are specifically set forth in or will become apparent from the following detailed description of preferred forms of the invention, when read in conjunction with the accompanying drawings.

DETAILED DESCRIPTION OF THE PREFERRED EMBODIMENT

Figure 1:
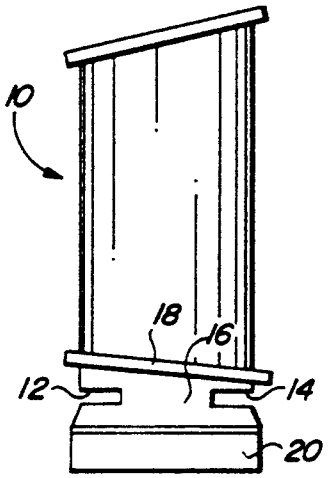
FIG. 1 (PRIOR ART)
FIG. 1 is a side elevational view of a test airfoil constructed in accordance with the principles of the prior art.
Figure 2:
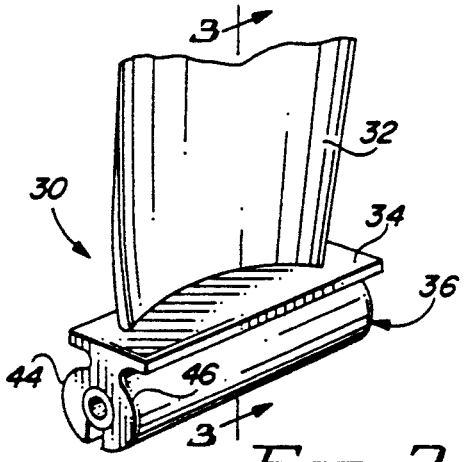
FIG. 2 is a partial, perspective view of a test airfoil constructed in accordance with the principles of the present invention.
Figure 3:
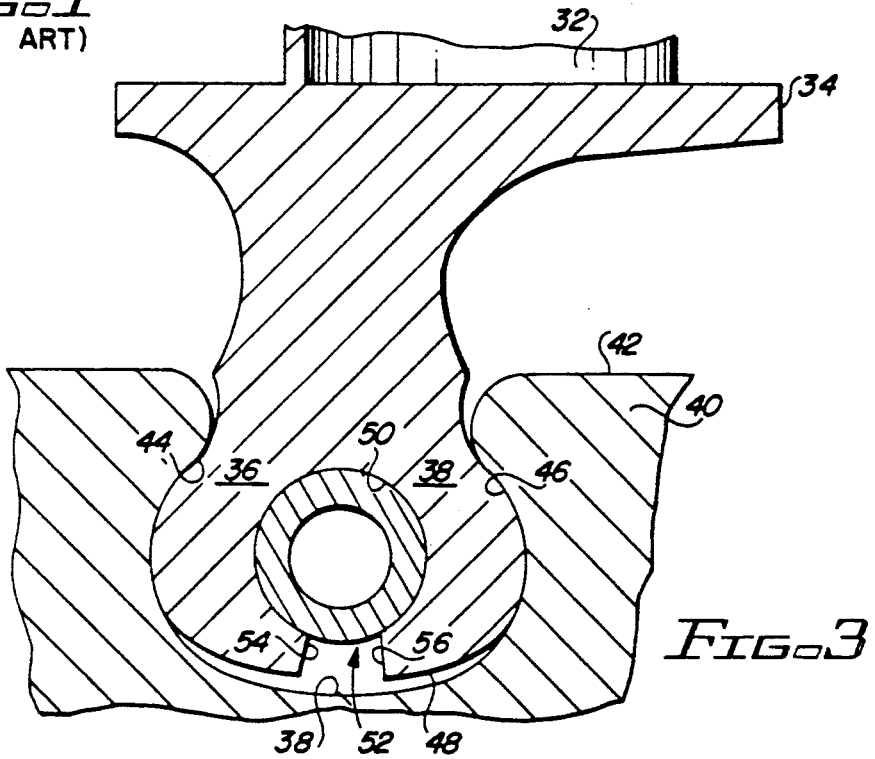
FIG. 3 is a partial, enlarged, plan cross-sectional view of the airfoil FIG. 3 as taken along lines 3—3 of FIG. 2, along with a portion of the rotary wheel upon which the airfoil is mounted.
Figure 4:
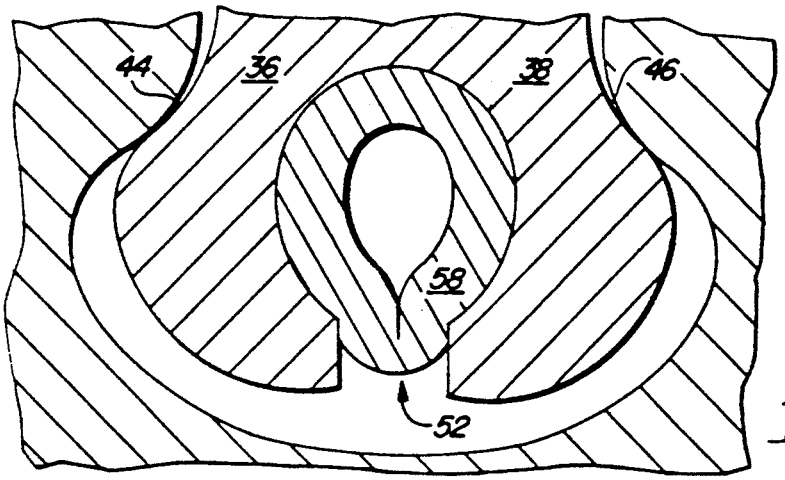
FIG. 4 is an enlarged plan cross-sectional view of the test airfoil and surrounding wheel just prior to failure.

Referring now more particularly to FIGS. 2–4, an airfoil, either a compressor blade or turbine blade is illustrated by the numeral 30 and includes integrally formed blade 32, platform 34, and a root 36 portions adapted to be attached in a rotary wheel of a gas turbine engine. As shown in FIG. 3, the root 36 slidably fits within a complementary shaped groove 38 of the wheel 40.

The blade illustrated has a dovetail shaped root 36 that extends radially inwardly from the blade platform 34 and is retainably carried within the groove 38 of the wheel 40 adjacent the outer periphery 42 of the wheel 40. The dovetail root 36 has generally radially outwardly facing, axially extending, load carrying faces 44, 46 which contact the adjoining shoulders of the wheel 40 to constrain the test blade 30 against centrifugal forces. The root 36 also has a radially innermost, axially extending bottom face 48.

As contemplated by the present invention, the dovetail root 36 also includes an internal, axially extending, through bore 50 and a radial slot 52 extending from bore 50 through the lower bottom face 48. The slot 52 has radially extending, generally parallel sidewalls 54, 56. Securely carried within internal through bore 50 is a tubular insert 58 which is made of a material having significantly less strength characteristics, particularly at the normal operating temperature of the airfoil 30.

During failure testing of the engine, the airfoil 30 is mounted within the wheel 40 as illustrated in FIG. 3 and the wheel gradually brought up to operating conditions of temperature and speed. As depicted in FIG. 4, the lower strength material of tubular insert 58 begins to gradually yieldably deform, tending to extrude out the lower radial slot 52, thereby allowing the root portion 36 and the entire blade airfoil 30 to shift gradually radially outwardly. This increases the stress placed on the airfoil, particularly greatly increasing the stress at shoulders 44, 46. The depiction in FIG. 4 is the condition of the test airfoil just prior to total failure.

As the insert 58 continues to yield, the root portion of the blade fractures from one or both of the shoulders 44, 46, through to the central bore 50, thereupon causing full release of the entire airfoil so that the destructive testing of the engine may continue.

In simulated testing of an airfoil 30 such as may be utilized as a turbine blade in a gas turbine engine, the insert material 58 was a magnesium alloy such as AMS 4418E in accordance with SAE Aerospace Material Specifications of Jan. 1, 1987. The Integral airfoil 30 was an investment cast nickel base, low carbon superalloy such as INCO 713 LC. A typical composition of INCO 713 LC is set forth below in weight percentages.

| Element | Min. Max. |
|---|---|
| Carbon | 0.05–0.07 |
| Manganese | — –0.25 |
| Sulfur | — –.015 |
| Silicon | — –0.50 |
| Phosphorus | — –0.015 |
| Chromium | 11.0–13.0 |
| Molybdenum | 3.8–5.2 |
| Columbium + tantalum | 1.5–2.5 |
| Titanium | 0.4–1.0 |
| Boron | 0.005–0.015 |
| Aluminum | 5.5–6.5 |
| Zirconium | 0.05–0.15 |
| Iron | — –0.25 |
| Copper | — –0.50 |
| Nickel | Remainder |
| Cobalt (if determined) | — –1.0 |

In a pull test simulation, a pulling load on the blade 30 was gradually increased until failure. Also time dependency tests were conducted where load was leveled off at a particular preselected level and then maintained until failure occurred. Additionally, as a baseline the blade was tested for failure load without installation of the insert 58. The design illustrated the following characteristics to establish its acceptability. First, with the insert 58 removed, the test airfoil 30 failed at a pull load of about 4508 pounds, well below the load for which the airfoil was designed to fail. Second, the airfoil, with filler pin installed and maintained at desired test temperature, failed at a very high load, 6680 pounds, in the maximum load test wherein the pull load was gradually and steadily increased until failure. Third, in the time dependency test, the pull load was placed at design point which was about 5765 pounds load and at the desired design test temperature of about 650° F. In this time dependency test, failure occurred at the design load and temperature conditions after 19.9 minutes, more than adequate time for the entire engine to reach stable operating conditions. This time dependency test establishes the design's inherent flexibility.

It is expected a variety of materials may be utilized for insert 58. The desirable material should show a steep drop off in strength and stiffness over the range of temperatures to which the airfoil is exposed from engine idle to steady state maximum power. Also, the maximum power conditions of the engine (i.e. temperature and speed) should place the insert material in a severe creep and stress rupture regime to thus promote a short, time dependent failure. Aluminum and magnesium alloys normally offer the desired characteristics in the temperature regimes expected of certain gas turbine engine blades. The magnesium alloy referred to above has its strength drop off dramatically in a range from about 500° F. to 700° F. Also, stiffness is reduced by approximately 30% in this same temperature range.

The slot 52 at the bottom of the dovetail is believed important during the failure modes because the slot 52 allows the two bottom portions of the dovetail to deflect toward one another. This places the contact zone of the dovetail, i.e. shoulders 44, 46 in much greater "bending" to yet further promote yielding.

It is possible to utilize other materials for the insert 58 which exhibits catastrophic failure at certain time dependent conditions, rather than the gradual yielding as discussed above. For example, it is believed that beryllium-copper significantly degrades in strength at a rapid rate when exposed to high temperature causing a sudden, complete fracture and failure.

Figure 7:
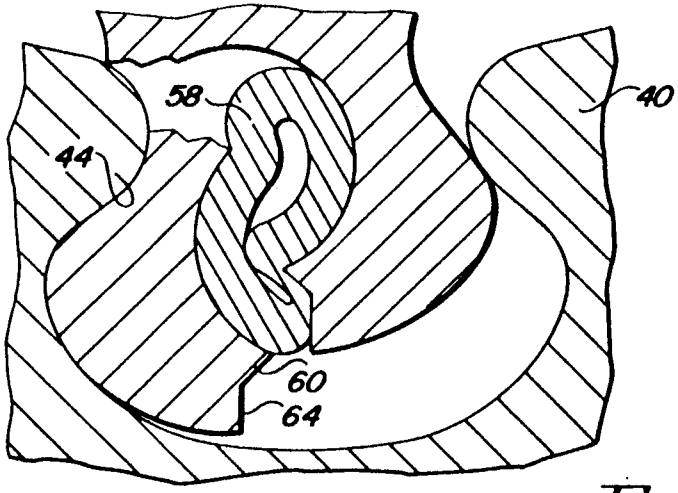
FIG. 7 is a view similar to FIG. 5 but showing the structure upon occurrence of failure and just prior to injection and release of the test airfoil.
Figure 5:
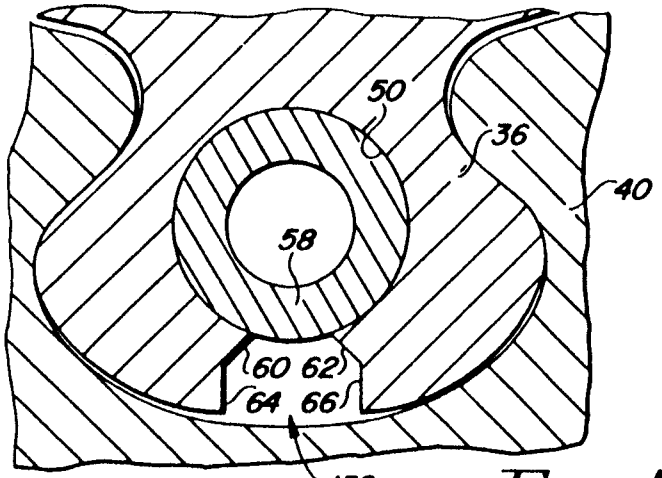
FIG. 5 is a view similar to FIG. 3 but showing an alternate embodiment of the invention.
Figure 6:
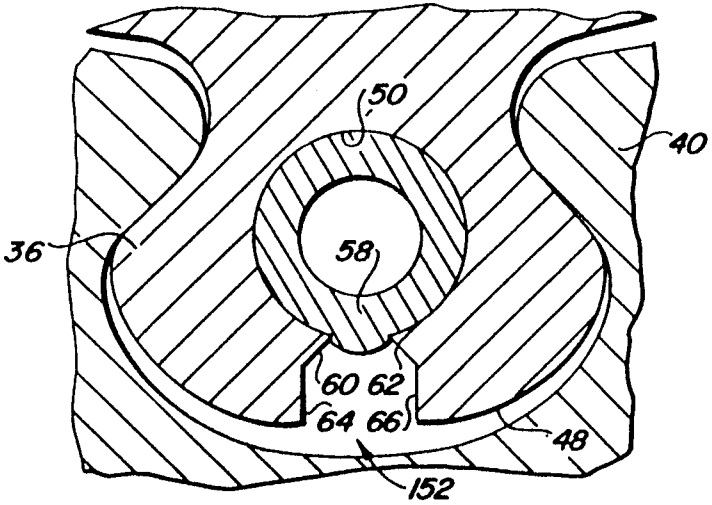
FIG. 6 is a view of the airfoil of FIG. 5 just prior to failure.

FIGS. 5–7 illustrate another embodiment of the invention which is like that illustrated in FIGS. 2–4, except for the configuration of the bottom slot in the dovetail root 36. More particularly, a bottom slot 152 is comprised of first segments 60, 62 that extend radially downwardly from the bore 50 to adjacent second segments 64, 66 that extend radially downwardly from the first segments all the way to the bottom face 48 of the dovetail. The first segments 60, 62 are inclined relative to one another with the narrowest opening of the slot 152 formed thereby being at the bore 50. The second segment 64, 66 are like the side walls 54, 56 of the FIG. 3 arrangement inasmuch as they are parallel to one another.

It is believed that the increased opening and inclined side walls 60, 62 allow greater extrusion of the insert 58 in to the bottom groove 152 without unnecessarily "pinching" the insert 58. That is, the insert 58 may continue to yieldably flow into the slot 152 without completely filling it up to create a "bridge" across the two lower portions of the dovetail which would tend to prevent further deflection of these two lower portions toward one another. As illustrated in FIG. 7, complete failure has occurred with the left-hand side of the dovetail root fracturing away from the remainder of the blade. FIG. 7 shows the structure just after failure and just prior to ejection of the main portion of the airfoil out of the wheel 40.

Figure 8:
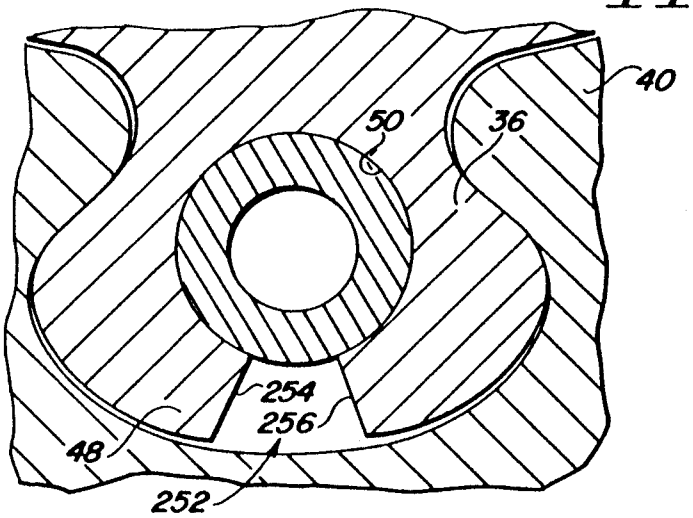
FIG. 8 is a view similar to FIG. 3 but showing yet another embodiment of the invention.

FIG. 8 illustrates yet another embodiment of the invention utilizing yet another configuration for the bottom slot. The bottom slot 252 of FIG. 8 includes fully inclined side walls 254, 256 extending from the bore 50 to the bottom face 48.

Various modifications to the specific structure described and illustrated above will be apparent to those skilled in the art. For example, the invention has been illustrated and described with respect to a "dovetail" configuration for the blade root. The same principles would apply in utilizing the invention in a "firtree" configuration for the blade root. Accordingly, the foregoing detailed description should be considered exemplary in nature and not as limiting to the scope and spirit of the invention as set forth in the appended claims.

Having described the invention with sufficient clarity that those skilled in the art may make and use it, what is claimed is:

1. A gas turbine engine airfoil designed for failure, comprising:

an aerodynamic blade adapted to be placed in momentum exchange relationship with a fluid stream;

a platform from which said blade extends radially outwardly;

a dovetail shaped root extending radially inwardly from said platform and adapted to be received in a generally complementally shaped groove at the outer periphery of a rotary wheel, said dovetail root having radially outwardly facing, axially extending, load carrying faces and an internal bore extending through its axial length; and a tubular insert within said internal bore, said insert being of a material having strength characteristics such that said insert fails under preselected conditions to cause release of the airfoil from the rotary wheel.

2. An airfoil for a gas turbine engine, said airfoil designed for deliberate failure during testing of the engine, said airfoil having an integral blade, platform and root of high strength material, said root having an axially extending internal bore therethrough; and an insert in said internal bore, said insert being of lower strength material such that said insert fails under preselected conditions to cause subsequent failure of the airfoil.

3. An airfoil as set forth in claim 2, wherein said insert is of tubular configuration.

4. An airfoil as set forth in claim 2, wherein said root is of dovetail configuration.

5. An airfoil as set forth in claim 2, wherein said high strength material is a nickel base superalloy.

6. An airfoil as set forth in claim 2, wherein said lower strength material is a beryllium-copper alloy.

7. An airfoil as set forth in claim 2, wherein said airfoil is a turbine blade.

* * * * *